US008544120B1

(12) United States Patent
Apgar et al.

(10) Patent No.: US 8,544,120 B1
(45) Date of Patent: Oct. 1, 2013

(54) DEVICE FOR THERMAL SIGNATURE REDUCTION

(75) Inventors: Brian P. Apgar, Mount Laurel, NJ (US); Enrico C. Ng, Delran, NJ (US); Jonathan D. Gruen, San Diego, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 36 days.

(21) Appl. No.: 13/410,541

(22) Filed: Mar. 2, 2012

(51) Int. Cl.
*B63C 11/08* (2006.01)
*B63C 11/24* (2006.01)
*B63C 11/00* (2006.01)

(52) U.S. Cl.
USPC ..... 2/458; 2/2.15; 2/2.17

(58) Field of Classification Search
USPC ..... 2/458, 2.11–2.17
See application file for complete search history.

(56) References Cited

U.S. PATENT DOCUMENTS 3,667,459 A * 6/1972 Durney ..... 128/201.15
3,667,460 A * 6/1972 Shepard ..... 128/201.15
4,547,906 A * 10/1985 Nishida et al. ..... 2/93
5,127,896 A * 7/1992 de Gaston ..... 600/20
5,722,482 A * 3/1998 Buckley ..... 165/10
5,846,063 A * 12/1998 Lakic ..... 417/440
6,127,007 A * 10/2000 Cox et al. ..... 428/15
6,165,036 A * 12/2000 Hino et al. ..... 446/154
6,276,155 B2 * 8/2001 Siman-Tov et al. ..... 62/259.3
6,338,292 B1 * 1/2002 Reynolds et al. ..... 89/36.02
6,883,185 B2 * 4/2005 Duncan ..... 2/458
6,969,399 B2 * 11/2005 Schock et al. ..... 607/108
7,160,316 B2 * 1/2007 Hamilton et al. ..... 607/111
7,190,636 B1 * 3/2007 Depaola ..... 367/131
7,583,196 B2 * 9/2009 Cohignac et al. ..... 340/573.1
7,832,018 B2 * 11/2010 Schwarz ..... 2/69
7,961,906 B2 6/2011 Ruedin
8,016,778 B2 * 9/2011 Brown et al. ..... 601/152
2004/0031090 A1 * 2/2004 Duncan ..... 2/458
2004/0225341 A1 * 11/2004 Schock et al. ..... 607/104
2006/0048777 A1 * 3/2006 Brookman ..... 128/201.22
2007/0072501 A1 * 3/2007 Holcombe et al. ..... 442/76
2013/0070079 A1 * 3/2013 Zitterbart et al. ..... 348/81

* cited by examiner

*Primary Examiner* — Bobby Muromoto, Jr.
(74) *Attorney, Agent, or Firm* — Howard IP Law Group, P.C.

(57) ABSTRACT

A device for reducing a thermal signature of a person includes: a hood sized and configured to cover a head of a person, having an inner substantially waterproof layer, an outer water wicking layer, and at least one tube having a plurality of openings therethrough attached to the inner layer; and a pump in fluid communication with the tubes to urge water into the tubes and cause the tubes to dispense water to the outer water wicking layer via the openings.

22 Claims, 7 Drawing Sheets

DEVICE FOR THERMAL SIGNATURE REDUCTION

FIELD OF THE INVENTION

This disclosure relates to devices and methods for reducing the thermal signature of a person.

BACKGROUND OF THE INVENTION

Surveillance for detection of persons, vehicles and other equipment is often conducted using infrared detectors. Infrared detectors can identify the location of persons and equipment based on variations between the surface temperature of objects in an ambient environment and the temperature of the skin and clothing of the individuals or the surfaces of equipment. Infrared detectors can thereby detect individuals and equipment in conditions in which detection using visible light would be ineffective, such as night time and low light conditions, and despite camouflage that renders individuals and equipment difficult to detect using optical wavelengths.

By way of example, a swimmer may seek to approach a shoreline from a body of water, without detection. As the swimmer approaches the shoreline, the swimmer's head and shoulders are above the surface of the water for extended periods of time in which the thermal energy radiated from these areas of the body may be easily detected with thermal sensors and imagers.

During an exemplary infiltration mission, a swimmer may approach an onshore area by entering the water in an area of open ocean beyond the surf region of the shoreline. The swimmer may need to swim along the shoreline to arrive at an approach area. While swimming parallel to the shoreline, the swimmer is in open ocean or in the surf and may be performing observation of the shore area in addition to swimming toward an intended approach region of the beach. In open ocean, the majority of the swimmer's body is beneath the water's surface and is thereby protected from detection by thermal imagers. However, the shoulders and head are exposed for most of this time having a potentially significant temperature gradient relative to the surrounding ocean and may easily be detected by infrared detection devices, such as thermal imaging devices. This facilitates detection of swimmers using thermal imaging devices, either from detection points on shore or from other vessels. A solution for addressing the foregoing challenges is desired.

SUMMARY

A device for reducing a thermal signature of a person includes, a hood sized and configured to cover a head of a person, having an inner substantially waterproof layer, an outer layer of a water wicking fabric, and a fluid delivery system attached to the hood and having a plurality of openings therein; and a pump in fluid communication with the fluid delivery system to urge water into the fluid delivery system and cause the fluid delivery system to dispense water on the hood via the openings.

In an embodiment, a headgear for reducing the thermal signature of a person, includes an inner layer of a thermally insulating material configured to cover the head of a person, with an opening for the face of the user; a fluid delivery system including tubes or bladders having openings therein attached to an outer surface of the inner layer, the tubes or bladders fluid in fluid communication with a source of fluid; and an outer layer of a water wicking material covering the inner layer and the tubes or bladders.

In an embodiment, a device for reducing the thermal signature of a swimmer in water includes a hood, a length of supply tubing, a submersible pump and a battery. The hood has an inner layer of an elastic, waterproof and thermally insulating material and is configured to cover a head of a person; a tubing manifold having an inlet and comprising a plurality of lengths of tubing having openings therein arranged on the outer surface of the inner layer; and an outer layer covering the inner layer and the tubing manifold, the outer layer being of a water wicking material. The length of supply tubing is connected to the inlet of the tubing manifold at a first end, and has a second end. The submersible pump has a pump inlet and a pump outlet, the pump outlet connected to the second end of the length of supply tubing. The battery is connected to the submersible pump.

In operation the battery powers the pump. The pump inlet is submerged, and receives water, which is pumped out via the pump outlet into the supply tubing, and from the supply tubing in to the tubing manifold. The tubing manifold receives the pressurized water from the pump via the supply tubing, and dispenses the water via the openings in the hood, thereby soaking the outer layer with water.

BRIEF DESCRIPTION OF THE DRAWINGS

The accompanying disclosure may be better understood when read in combination with the accompanying figures in which.

DETAILED DESCRIPTION

Embodiments of the disclosed devices and methods are described with sufficient detail to enable one of ordinary skill in the art to practice the invention. However, details of components of the disclosed devices and methods that are known in the art are not described herein in detail.

An example of an individual seeking to reduce their thermal signature from infrared detection is a combat swimmer. Combat swimmers are commonly deployed from vessels or aircraft into a body of water, such as an ocean, sea, bay, harbor, river, lake, estuary or other body of water, at a distance from the location on a shoreline on which swimmers plan to go ashore. The swimmer may be required to swim substantial distances along the shoreline (e.g. parallel with the beach or upstream or downstream in a river) prior to reaching the location on shoreline where the swimmers plan to go ashore. While swimming, the swimmer may stop and perform observation activities. While swimming, the majority of the swimmer's body is submerged. For example, while performing a sidestroke, the swimmer's body is submerged except for part of one shoulder and the neck and head.

A thermal imager detects infrared radiation and may provide a display including an enhanced digital image. In such an enhanced digital image, ranges of colors are assigned to varying values or bands of intensity of detected infrared radiation. Thus, differences in temperature within and among objects in the field of vision appear as different colors.

As noted above, much of the swimmer's body is submerged while swimming. Portions of the body that are submerged are not visible on a thermal imager's display. However, the swimmer's head is often above the water and is generally warmer than the temperature of the water. For example, in open water the temperature of a swimmer's head may be warmer than the surrounding water by 15 degrees or more. This significant temperature gradient makes the swimmer's head appear as an orb that may be brighter than surrounding areas within the field of vision and/or be represented in a different color, when viewed through a thermal imager. This high visibility of a swimmer's head in a thermal imager is referred to as the "glowing pumpkin" problem.

Figure 1:
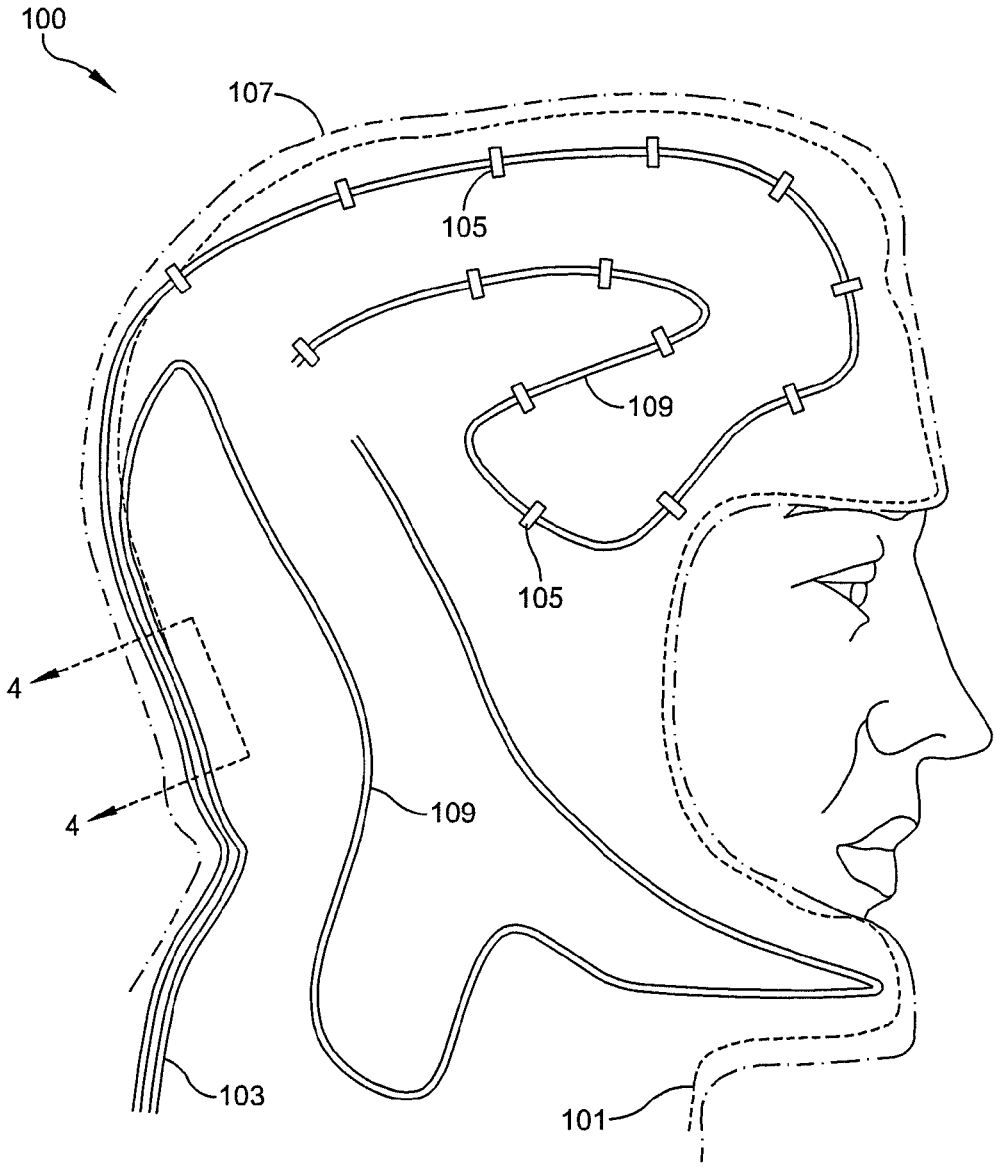
FIG. 1 shows a device for reducing the thermal signature of a swimmer in the water according to an embodiment.

FIG. 1. is an illustration of a device 100 for reducing the thermal signature created by the head of a person. As depicted in FIG. 1, a hood having an inner layer 101, outer layer 107, and fluid transport mechanism 103 for delivering fluid to the hood, is configured to be worn over the head of a person. The hood is sized and shaped to cover the back, sides and top of a head of an adult person. The hood has an opening to accommodate the face of an adult. The opening for the face may have different dimensions than that illustrated in FIG. 1. For example, the opening may be larger or smaller than that depicted in FIG. 1. By way of example, a smaller opening may be utilized to further minimize the area of exposed portion of the face. The inner layer 101 may be of a waterproof material and sized for a snug fit on the back, sides and top of the head of a person.

Fluid transport mechanism 103 includes tubing 109. Tubing 109 includes one or more tubes for carrying a fluid, such as water, from a source of pressurized fluid to a portion of the hood for covering the head of a user. The tubes are flexible, are attached to the hood, and have openings to permit a fluid, such as water, to be dispensed in the portion of the hood for covering the head of the user. The tubes are in fluid communication with a source of pressurized fluid. Tubing 109 may be arranged in tubes that have a proximal end in communication with a source of pressurized fluid and one or more branches terminating on a portion of the hood for covering the head of the user. The arrangement of the tubing on the hood and the openings on the tubing may be configured to provide openings on or near portions of a user's head where maximum heat is generated. The tubing 109 may be fastened to the inner layer of the hood by any suitable fasteners, including stitched thread, zip ties of plastic, staples of plastic or metal, and adhesives, by way of example. The fasteners may be positioned at positions spaced apart from one another along the tubes. The spacing of the fasteners may be sufficiently great that the tubing does not interfere with stretching and flexibility of the fabric of the inner layer. The elasticity and flexibility of the fabric facilitates donning and doffing of the hood.

An outer layer 107 covers both the inner layer 101 and the tubing of the fluid transport mechanism 103. The outer layer 107 may be of a water wicking fabric. In a water wicking material, such as a water wicking fabric, when water comes in contact with the surface of the material, the water tends to be transported water through the material and laterally within the material. A water wicking material may tend to distribute water evenly throughout the fabric. A water wicking material does not necessarily absorb water as significantly as highly water absorbent fabrics, such as cotton. However, in an embodiment, outer layer 107 may be of a highly water absorbent fabric. The fabric may be a hydrophilic fabric. The fabric may direct water, through mechanisms such as capillary action, into the fabric. The fabric may wick water from the inner surface of outer layer 107 to wet a cross sectional extent of the fabric and to wick water through the fabric to the outer surface of outer layer 107. The fabric may be woven or non-woven. The fabric may be a woven fabric of a fire resistant fiber, such as an aramid fiber. The outer layer may be fastened to the inner layer, to the tubing, or both, by any suitable fasteners, such as adhesives, stitched fabric, plastic ties, or metal or plastic staples.

According to an embodiment of device 100, the fluid transport mechanism 103 may receive the water from the environment in which the individual is swimming, such as seawater in an ocean environment. For a swimmer in the open ocean or other body of water, the supply of surrounding fluid having a temperature substantially equal to the surrounding water is essentially limitless. In addition, no further heat exchange needs to occur to bring the fluid to a temperature that is substantially equal to the surrounding water allowing for a device 100 that is simple in design, manufacture and operation.

Figure 2:
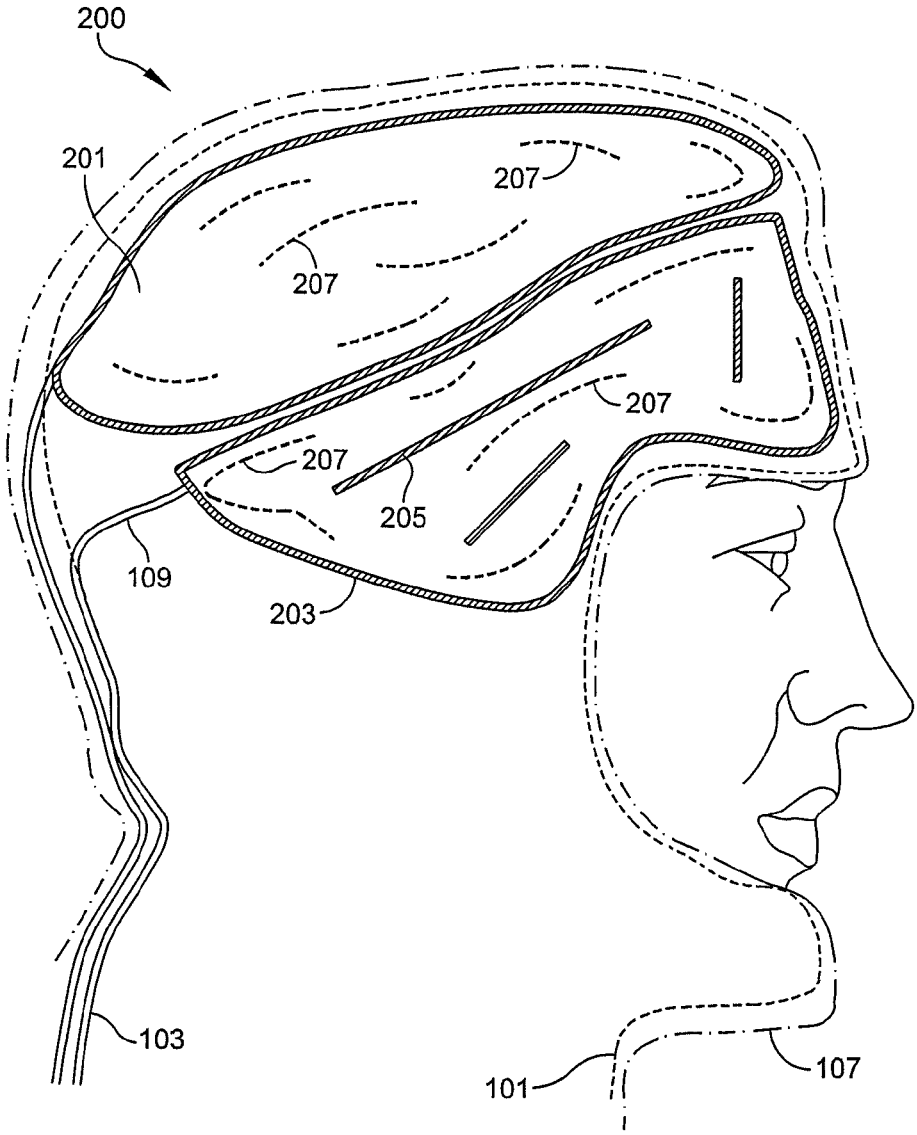
FIG. 2 shows a device for reducing the thermal signature of a swimmer in the water according to an embodiment.

FIG. 2 shows an embodiment of a device 200 for reducing the thermal signature of a swimmer. The basic components of the embodiment of FIG. 2 are similar to those illustrated in FIG. 1, with the exception that, rather than tubing with openings, the fluid transport mechanism is configured to deliver fluid through tubes to one or more bladders 201, 203. Bladders 201, 203 are on inner layer 101. Bladders 201, 203 have openings 207 therein. Inner layer 101 covers much of the swimmer's head, having a limited opening for the swimmer's face.

The shape of bladders 201, 203 may cover identified areas of the swimmer's head where a greatest amount of heat is generated. The bladders 201, 203 may be fastened to the inner layer 101 by suitable fasteners. The fasteners may be any type of fastener which secures the bladders 201, 203 to inner layer 101, such as stitched fabric, adhesives, plastic ties or metal or plastic staples. Bladders 201, 203 may be of a flexible waterproof substance, such as a flexible waterproof plastic material or a natural or synthetic rubber. Bladders 201, 203 may be configured with a mechanism such as openings 207, to prevent the volume of the bladders from exceeding a maximum volume notwithstanding the introduction of fluid into the bladders. Openings 207 may be made in bladders 201, 203 independently, or may be provided in combination with centrally placed reinforcement seams which further serve as fasteners 205. Bladders 201, 203 may be also be internally fastened together by adhesive or other fasteners at 205, for example. Bladders 201, 203 thereby maintain a relatively flat profile on the head of the swimmer. By way of further example, the bladders may be configured with valves or apertures to dispense the fluid if the pressure in the bladders exceeds a limit. In an embodiment, return tubes may be provided from the bladders to the fluid transport system to permit recirculation of the fluid. By controlling the pressure and volume of fluid in bladders 201, 203, optimal fluid flow may be obtained which results in the most effective mitigation of the thermal signature.

Outer layer 107, as discussed in connection with the embodiment of FIG. 1, covers both the inner layer 101 and the bladders 201, 203. Bladders may have openings in contact with outer layer 107. The locations of openings in bladders 201, 203 may be rearward of the opening in inner layer 101 for the face of the swimmer, so that, when the swimmer's head is upright, fluid exiting the openings in the bladders will tend to flow downward and to the back of the swimmer's head. These locations of the openings in the bladders 201, 203 tend to prevent flow from obscuring the swimmer's vision or impairing the swimmer's breathing.

Figure 3:
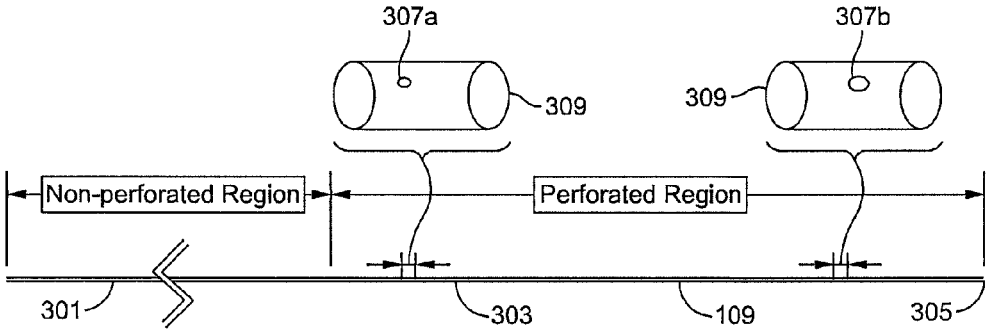
FIG. 3 is an illustration of a fluid transport component of a device for reducing the thermal signature of a swimmer in water according to the embodiment of FIG. 1.

FIG. 3 is a partially exploded view of a tube 109 which may be used in the embodiment of device 100 shown in FIG. 1. Tube 109 defines two regions, namely a first non-perforated region 301, and a second, perforated region 303. First non-perforated region 301 generally extends from a source of pressurized fluid to the hood. First non-perforated region 301 provides for transport of a fluid from its source to an area of the user's head, without loss of fluid. Second, perforated region 303 is on the hood, and provides for dispensing of the fluid. The perforated region 303 includes openings through the wall of tube 109 and generally denoted as 307*a*, 307*b*. Openings 307*a* are closer to the source of the fluid than openings 307*b*. Opening 307*a* may have a smaller cross sectional area than opening 307*b*. The fluid pressure at opening 307*a*, which is closer to the source of fluid, will be higher than the pressure at opening 307*b* which is farther away from the fluid source; accordingly, the difference in the cross-sectional area of openings may tend to maintain a same or similar flow of fluid out of tube 309 at varying distances from the fluid source. Alternatively, different densities of openings per unit length of tube may be employed to maintain even flow of fluid out of the tube 309. While openings 307*a* and 307*b* may be circular as shown, other geometric shapes, or slits through the wall of tube 309, may be employed.

Figure 4:
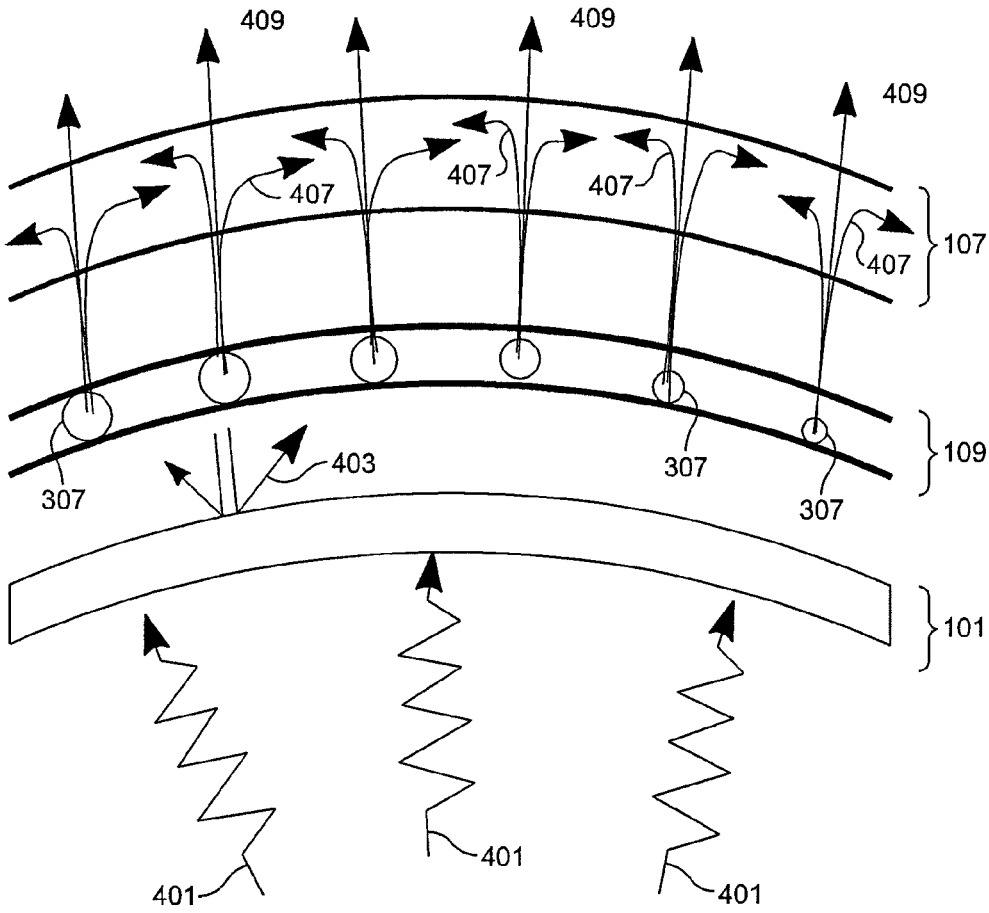
FIG. 4 is a cross sectional view of a hood arrangement for reducing the thermal signature of a swimmer according to an embodiment.

Referring now to FIG. 4, a partial cross-sectional view of device 100 from FIG. 1 is shown. Inner layer 101 is in close proximity to the swimmer's head. Outer layer 107 forms an exterior surface of device 100. Intermediate inner layer 101 and outer layer 107, tubing 109, having openings 307 therein, is provided. The inner layer 101 may be made of a material that is thermally insulating, waterproof, flexible and elastic. For example, inner layer 101 may be made from a natural rubber or a synthetic rubber such as neoprene. In use, the head of a user produces heat 401, which increases the temperature of the inner surface of inner layer 101. The outer surface of inner layer 101 will be in contact with ambient water at an ambient temperature less than the temperature of the skin of the user. As a result of the thermally insulating properties of inner layer 101, a temperature gradient is maintained across inner layer 101, and the outer surface of inner layer 101 will tend to have a temperature at or closer to that of the water, and the body heat 401 will not tend to heat the water contacting the outer surface of inner layer 101. In addition, as the material of inner layer 101 is waterproof, water dispensed inner layer 101 prevents the flow of water from tubing 109 to the swimmer's head. Instead, the water is repelled 403 back into the region containing the tubing 109 and the outer layer 107.

Tubing 109 is disposed between inner layer 101 and outer layer 107. While FIG. 4 shows spacing between the tubing and each of inner layer 101 and outer layer 107, it should be understood that such spacing is shown for the purposes of illustration only, and tubing 109 may be in contact with either or both of inner layer 101 and outer layer 107. Tubing 109 has openings 307 through its wall. Openings 307 accordingly serve to dispense fluid pumped from a source. The dispensed fluid may be wicked through outer layer 107 in the transverse direction shown at 407 to generally soak outer layer 107. Dispensed fluid may also be transmitted through outer layer 107 to an outer surface of outer layer 107, as shown at 409. The ends of the tubing may be closed in embodiments, or open in other embodiments.

By way of non-limiting example, outer layer 107 may be made of a weave of a fireproof aramid fiber, such as the NOMEX® brand of aramid fiber, manufactured by E.I. du Pont de Nemours and Company, Wilmington, Del., USA. Other materials having the desired absorption and wicking characteristics may also be used. Outer layer 107 may be printed with one or more camouflage patterns. Outer layer 107 may be removable from the device 100, so that different desired patterns, colors and fabrics may be employed. The colors and patterns may be selected to minimize the risk of optical detection of a swimmer, to have an emissivity when wet that closely approximates the emissivity of the water surface, and may be selected to match conditions and anticipated ambient environments. By way of non-limiting example, the colors and fabric selected for the outer layer 107 may have a selected reflective quality when wet, that produces a sheen similar to that experienced by an observer looking at the water's surface, taking into account the current conditions under which observation is taking place. For example, during a nighttime or moonlit infiltration mission under clear skies, the outer layer 107 may be selected to be similar in color and sheen of the surface of the water in which moonlight is partially illuminating and reflecting off of the water's surface. Different outer layers 107 may be used to approximate that existing conditions and optimize the reduction of the thermal and optical signature of the swimmer.

Figure 5:
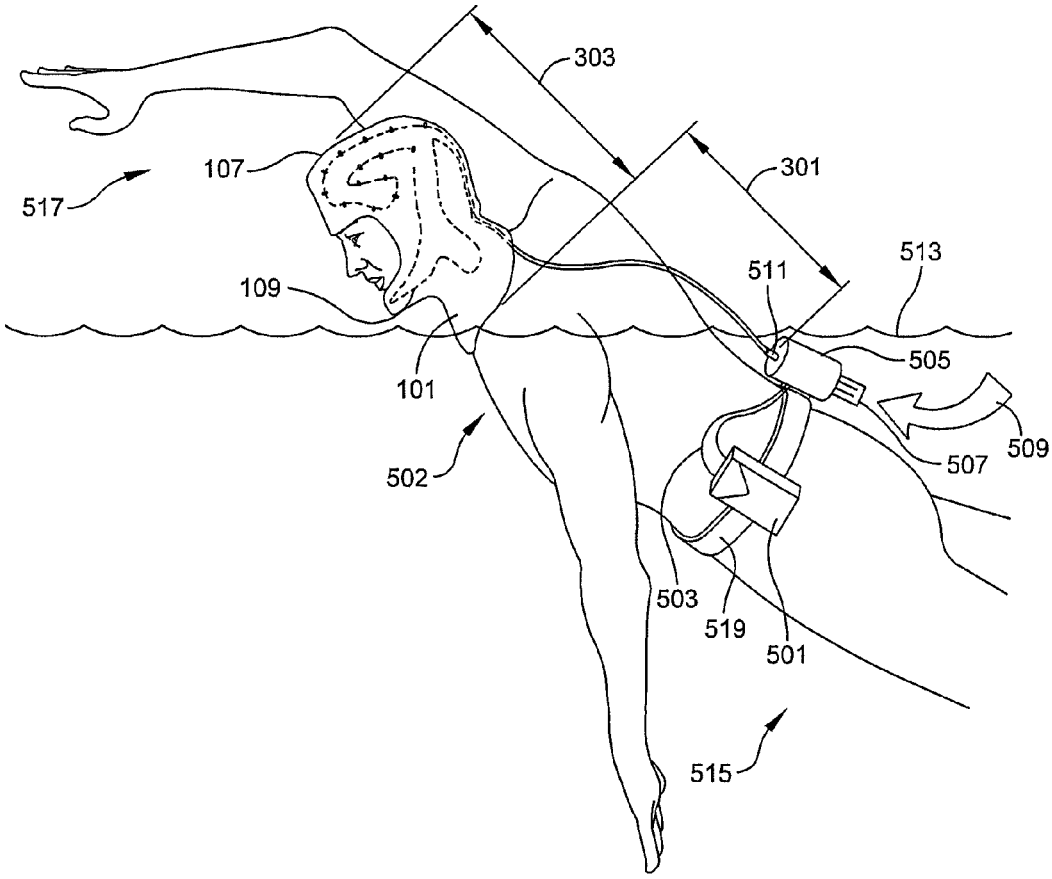
FIG. 5 is an illustration of a swimmer and a device for reducing the thermal signature of a swimmer according to an embodiment.

FIG. 5 illustrates the use of a device for reducing the thermal signature of a swimmer. A swimmer 502 is shown swimming at the water's surface 513. The swimmer 502 may be swimming using a swimming stroke, such as side stroke, which causes a non-submerged portion 517 of the swimmer's body to be exposed above the water's surface 513, and a submerged portion 515 which remains below the water's surface 513. The surfaces, both skin and garment covered, of the non-submerged portion 517 generally have a temperature significantly higher than the temperature of the surrounding water. The physical exertion of the swimmer generates body heat, which further tends to increase the surface temperature of the swimmer's 502 head. The notable temperature gradient between the non-submerged portion 517 of the swimmer's 502 body and the surrounding water allows the swimmer 502 to be easily detected in images generated by thermal imaging devices.

The swimmer 502 wears headgear including a hood having an inner layer 101, an outer layer 107, and tubing 109. The inner layer 101, as discussed above, is made of a material having properties including: flexibility and elasticity, to permit a snug fit on the swimmer's head, waterproof, to prevent water from transiting the inner layer 101, and thermal insulation, to permit a thermal gradient between its inner surface in contact with the swimmer's head and its outer surface. Inner layer 101 may be of a natural or synthetic rubber. The inner layer 101 substantially covers the swimmer's 502 head, except for a small area around the face which allows for vision and breathing.

An arrangement of tubing 109 is attached to inner layer 101 and arranged about the outer surface of the inner layer 101. The tubing 109 defines a manifold that receives water from the swimmer's 502 surroundings and dispenses the water about inner layer 101. The dispensed water is at substantially the same temperature as the water surrounding the swimmer 502. The tubing 109 has apertures (307 shown in FIG. 3) through the walls of the tubing 109 to allow the water received from the surroundings to be dispensed from the tubing 109 in the region surrounding the swimmer's 502 head.

Outer layer 107 covers the tubing 109 and the inner layer 101. The outer layer 107 is made from a material selected for its ability to wick the water as it is dispensed from the apertures defined in tubing 109, both through the fabric and longitudinally throughout the fabric. In embodiments, outer layer 107 may be a highly water absorbent fabric. As water is received and dispensed from tubing 109 at a temperature substantially equal to the surrounding water, the water soaks the outer layer 107 and renders the temperature of the outer layer 107 substantially equal to the temperature of the surrounding water. The thermal insulating properties of the inner layer 101 tend to prevent heating of the water soaking the outer layer 107 as a result of the heat emitted by the swimmer. Thus, the thermal signature of the swimmer's head is reduced, such that the image of the swimmer's head on displays of thermal imaging devices is minimized.

The surrounding water may be provided to the tubing 109 by way of a non-perforated length of tubing 301. The non-perforated tubing 301 is coupled to a manifold of tubing 109 which distributes and dispenses the water in the area of second outer layer 107. Generally, perforated region 303 of tubing 109 is located on the non-submerged region 517 of the swimmer's 502 body. The non-perforated region 301 connects the tubing 109 manifold in the non-submerged region 517 to the submerged region 515 where the non-perforated 301 tube is coupled to a source of pressurized water, which source may be an outlet 511 of a submersible pump 505. The submersible pump 505 may be attached to the swimmer 502, for example at the swimmer's 502 belt 519. The submersible pump 505 may receive power through a connection 503 to a battery 501. A switch may be provided to cause current to flow from the battery 501 to the pump 505. Alternatively, the connection 503 may be manually connected and disconnected when desired. The battery 501 may also be carried on the swimmer's 502 belt 519, or may be stowed in a pocket or other part of the swimmer's 502 clothing or gear. In an embodiment, the battery and the pump may be integrated and contained within a single housing. The power requirements of the submersible pump 505 are relatively small, so that when the swimmer 502 completes the part of the mission requiring swimming in the open ocean or surf, the submersible pump 505 may be disconnected from the battery 501 allowing the battery 501 to be used for other purposes.

While receiving power, the submersible pump 505 draws surrounding water 509 through the pump inlet 507. The surrounding water 509 is pumped by submersible pump 505 via the pump outlet 511 through the non-perforated region 301 of tubing 109, through the perforated region 303 about the head of swimmer 502. The water is dispensed from tubing 109 by apertures in the walls of the tubing 109 which allow the water to be dispensed around the head of the swimmer 502 and wicked and/or absorbed by outer layer 107.

In an embodiment, the pump is a mechanical pump, and a power source, rather than a battery, is a mechanism to power the pump using kinetic movement of the swimmer.

In operation, while swimming in open ocean or surf, the swimmer dons device 100. A fluid is transported through tubing 109 and is carried through the tubing 109 between inner layer 101 and outer layer 107. Tubing 109 is configured to dispense the fluid at a temperature substantially equal to the water surrounding the swimmer. The dispensed fluid is wicked through the fabric of outer layer 107 to provide a surface area covering most of the swimmer's head in fabric soaked with fluid at a temperature substantially equal to the surrounding water. When a field of view including the swimmer equipped with device 100 and surrounding water is viewed through a thermal imager, there is little or no thermal signature produced by the head of the swimmer. The covered head of the swimmer, including the soaked fabric of the outer layer 107, is maintained at a temperature gradient relative to the surrounding water that produces a contrast in a thermal image which is significantly less that that of an uncovered head.

Figure 6:
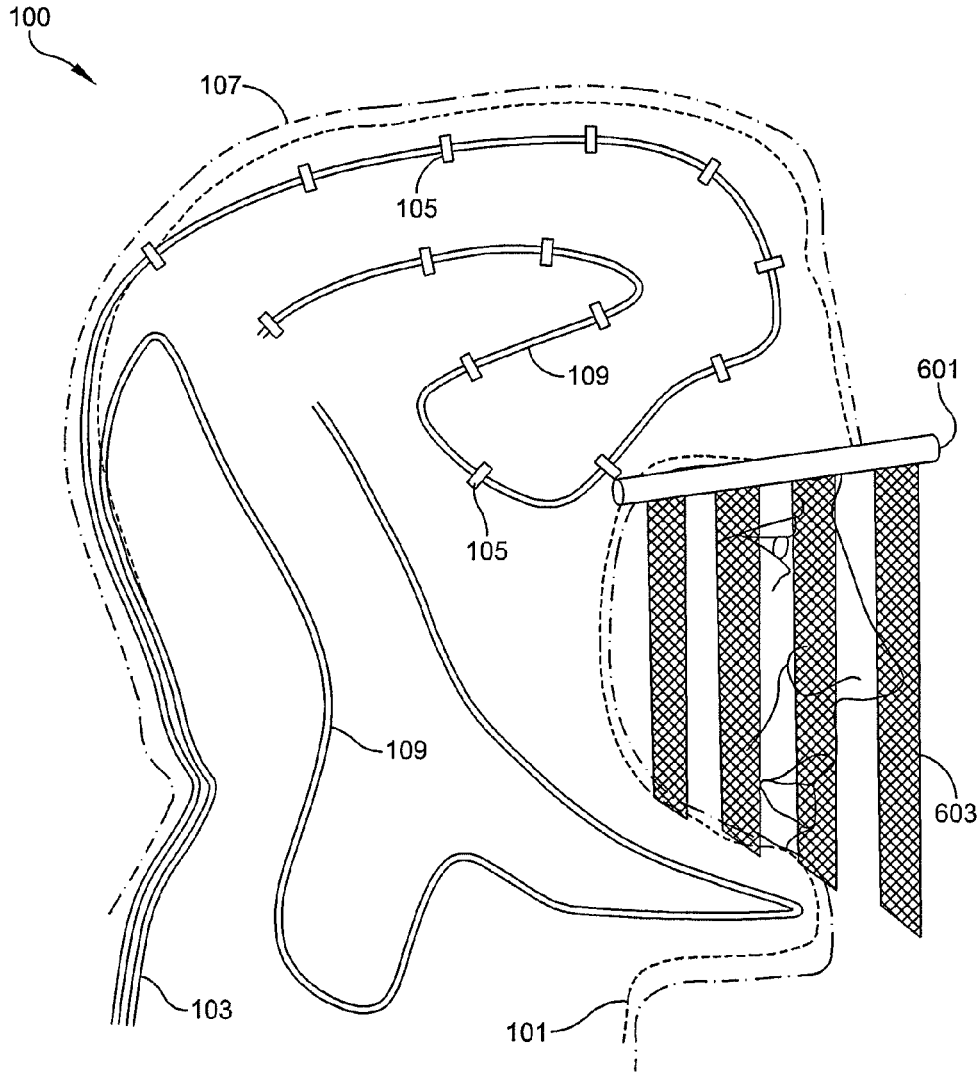
FIG. 6 shows a device for reducing the thermal signature of a swimmer in the water according to an embodiment.

In an embodiment as shown in FIG. 6, the device 100 or the device 200 may include one or more strips of fabric 603 suspended from the outer layer 107 in a configuration to cover, at least partially, the portion of the user's face that is uncovered. The strips 603 may be spaced to permit the user to see around the strips 603. The strips 603 may be on rigid or semi-rigid supports 601 to provide spacing between the swimmer's face and the strips 603. The strips 603 may be of hydrophilic fabric or fabric with capillary fluid transport characteristics and in contact with or adjacent to openings in the fluid delivery system, so that the strips 603 are soaked with fluid.

Figure 7:
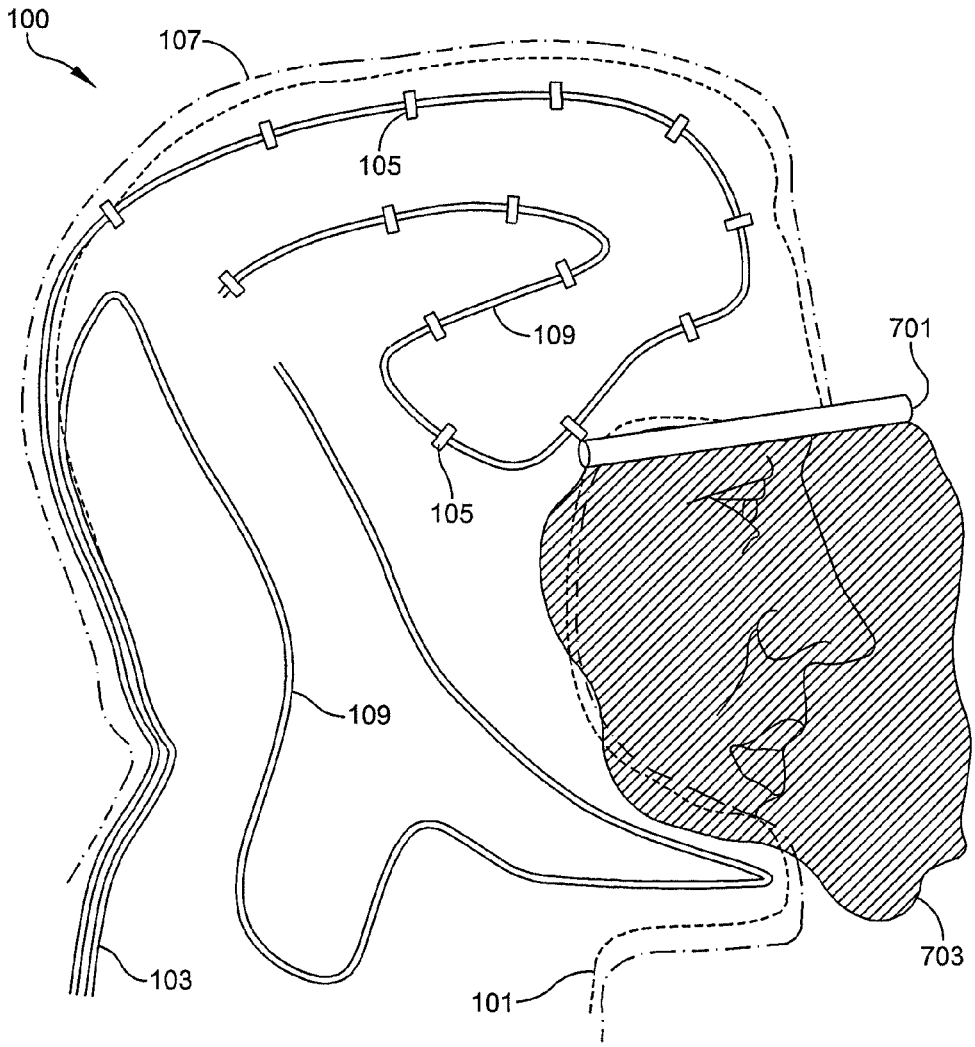
FIG. 7 shows a device for reducing the thermal signature of a swimmer in the water according to an embodiment.

According to another embodiment shown in FIG. 7, a fine mesh fabric 703 may be attached to the inner layer 101 or the outer layer 107 and extend across the opening in the inner layer 101 for the user's face. The fine mesh fabric 703 may be on rigid or semi-rigid supports 701 to provide spacing between the swimmer's face and the fine mesh fabric 703. The fine mesh fabric 703 may be in contact with openings of the fluid delivery system so as to be soaked with the fluid and reduce the thermal signature produced by the swimmer's face.

In an embodiment, inner layer 101 may be of neoprene, with a thickness of about 3 millimeters. Outer layer 107 may be a woven fabric of NOMEX brand fiber. The pump 505 may have 200 gallon per minute maximum flow rate, although operation at 2.2 gallons per minute has been found to be sufficient. The pump 505 may be powered by a 12 volt DC battery. The battery chemistry may be lead-acid, by way of example, or other battery types may be used, such as nickel metal hydride (NiMH), lithium ion, or the like. The tubing may be of ¼ inch polyethylene. In an embodiment, the weight of the device 100, including the inner and outer layers, the tubing, the pump and the battery may be not more than about 2 pounds.

The preceding description is provided only by way of example. A person of ordinary skill in the art may recognize other combinations or components that may be used in the disclosed descriptions without departing from the intended scope of the disclosure. Embodiments including additional or substituted components may be devised with fall within the intended scope of this disclosure.

What is claimed is:

1. A device for reducing a thermal signature of a person, comprising:

a hood sized and configured to cover a head of a person, having an inner thermally insulating and substantially waterproof layer, an outer water wicking layer, and a fluid delivery system attached to the hood and having a plurality of openings therein; and a pump in fluid communication with the fluid delivery system to urge water into the fluid delivery system and cause the fluid delivery system to dispense water on the hood via the openings.

2. The device of claim 1, wherein said inner layer comprises rubber.

3. The device of claim 2, wherein said inner layer comprises neoprene.

4. The device of claim 1, wherein said outer layer is of fabric.

5. The device of claim 1, wherein the pump is a submersible pump having an inlet and an outlet in fluid communication with the one or more tubes.

6. The device of claim 1, wherein said fluid delivery system comprises tubing having openings therein on the hood and intermediate the inner layer and the outer layer.

7. The device of claim 1, wherein said fluid delivery system comprises a plurality of bladders having openings therein.

8. The device of claim 1, further comprising a battery in electrical communication with the pump.

9. The device of claim 1, wherein the pump is a mechanical pump, and further comprising a mechanism to power the pump using kinetic movement of the swimmer.

10. The device of claim 1, further comprising a power source for powering the pump, and wherein said pump and said power source are configured to be carried on a belt.

11. A headgear for reducing the thermal signature of a person, comprising:

an inner layer of a thermally insulating material configured to cover the head of a person, with an opening for the face of the user;

a fluid delivery system including tubes or bladders having openings therein attached to an outer surface of the inner layer, the tubes or bladders fluid communication with a source of fluid; and an outer layer of a water wicking material covering the inner layer and the tubes or bladders.

12. The headgear of claim 11, wherein the fluid delivery system comprises bladders having openings therein on the outer surface of the inner layer and lengths of tubing in fluid communication with the bladders and a source of fluid.

13. The headgear of claim 11, wherein the fluid delivery system comprises a plurality of tubes having openings therein, the openings closer to the source of fluid being smaller than the openings further from the source of fluid.

14. The headgear of claim 11, wherein said inner layer is of a rubber.

15. The headgear of claim 14, wherein said inner layer is of neoprene.

16. The headgear of claim 11, wherein said outer layer is of a woven fabric of a fiber.

17. The headgear of claim 11, wherein said outer layer is of a woven fabric of an aramid fiber.

18. The headgear of claim 11, wherein said outer layer is of a non-woven fabric.

19. The headgear of claim 11, further comprising a plurality of fabric strips extending from the outer layer and positioned to hang over the opening for the face of the user in the inner layer.

20. The headgear of claim 19, wherein the fabric strips are made from a same material as the outer layer.

21. The headgear of claim 11, further comprising a mesh material attached to the hood and positioned to cover the opening for the face of the user.

22. A device for reducing the thermal signature of a swimmer in water, the device comprising:

a hood having:

an inner layer of an elastic, waterproof and thermally insulating material and configured to cover a head of a person;

a tubing manifold having an inlet and comprising a plurality of lengths of tubing having openings therein arranged on the outer surface of the inner layer; and an outer layer covering the inner layer and the tubing manifold, the outer layer being of a water wicking material;

a length of supply tubing connected to said inlet of said tubing manifold at a first end;

a submersible pump having a pump inlet and a pump outlet, the pump outlet connected to a second end of the length of supply tubing; and a battery connected to said submersible pump.

* * * * *